US006216782B1

(12) United States Patent
Skinner

(10) Patent No.: US 6,216,782 B1
(45) Date of Patent: Apr. 17, 2001

(54) APPARATUS AND METHOD FOR VERIFICATION OF MONOPHASIC SAMPLES

(75) Inventor: Neal G. Skinner, Lewisville, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/313,936

(22) Filed: May 18, 1999

(51) Int. Cl.[7] ..... E21B 47/06; E21B 49/08

(52) U.S. Cl. ..... 166/250.01; 166/64; 166/264; 73/152.28

(58) Field of Search ..... 166/250.01, 250.17, 166/264, 64, 162, 163, 165; 73/152.23, 152.28, 152.27

(56) References Cited

U.S. PATENT DOCUMENTS

| | | | | |
|---|---|---|---|---|
| 4,370,886 | | 2/1983 | Smith et al. . | |
| 5,687,791 | * | 11/1997 | Beck et al. | 166/250.07 |
| 5,901,788 | * | 5/1999 | Brown et al. | 166/264 |
| 6,065,355 | * | 5/2000 | Schultz | 73/864 |

FOREIGN PATENT DOCUMENTS

| | | | |
|---|---|---|---|
| 0255976 A2 | 2/1988 | (EP) | E21B/49/08 |
| 0295923 A2 | 12/1988 | (EP) | E21B/49/08 |
| WO 96/12088 A1 | 4/1996 | (WO) | E21B/49/08 |
| WO 00/34624 A2 | 6/2000 | (WO) | E21B/49/08 |

* cited by examiner

*Primary Examiner*—David Bagnell
*Assistant Examiner*—Jennifer R. Dougherty
(74) *Attorney, Agent, or Firm*—Paul I. Herman; Lawrence R. Youst

(57) ABSTRACT

A formation fluid sampling apparatus (40) for verification of monophasic samples is disclosed. The apparatus (40) comprises a housing (42) having a sampling chamber (48) and a sampling port (50) defined therein. The sampling port (50) is in communication with the sampling chamber (48) and the formation traversed by the wellbore such that formation fluids may be collected in the sampling chamber (48). A temperature monitoring device (52) monitors the temperature of the formation fluids collected in the sampling chamber (48). A temperature recorder (46) that is operatively connected to the temperature monitoring device (52) is used to record the temperature fluctuations of the formation fluids in the sampling chamber (48) to determine whether the formation fluids undergo phase change degradation during collection of the fluid sample and retrieval of the formation fluid sampling apparatus (40) from the wellbore.

14 Claims, 3 Drawing Sheets

APPARATUS AND METHOD FOR VERIFICATION OF MONOPHASIC SAMPLES

TECHNICAL FIELD OF THE INVENTION

This invention relates in general to testing and evaluation of subterranean formation fluids and, in particular to, a fluid sampling tool and method for monitoring the temperature of the sample to determine whether the sample has undergone phase change degradation during collection or retrieval from the wellbore.

BACKGROUND OF THE INVENTION

Without limiting the scope of the present invention, its background is described with reference to testing hydrocarbon formations, as an example.

It is well known in the subterranean well drilling and completion art to perform tests on formations intersected by a wellbore. Such tests are typically performed in order to determine geological or other physical properties of the formation and the chemical and physical properties of the fluids contained therein. For example, parameters such as permeability, porosity, fluid resistivity, temperature, pressure and bubble point may be determined. These and other characteristics of the formation and fluid contained therein may be determined by performing tests on the formation before the well is completed.

One type of testing procedure is to obtain a fluid sample from the formation to, among other things, determine the composition of the formation fluids. In this procedure, it is important to obtain a sample of the formation fluid that is representative of the fluids as they exist in the formation. For example, the sample is used to determine the economic value of fluids within the formation. In addition, the composition of the formation fluids is used to determine the type and capacity of the processing equipment required to process fluids extracted from the formation.

In the past, sampling of formation fluids was accomplished by collecting a large volume of fluid through the drill string which may be on the order of thousands of gallons of formation fluids. This type of large scale sampling is, however, timely and expensive. In an alternative sampling procedure, formation fluids may be sampled on a smaller scale by lowering a sampling tool into the wellbore on a wireline, slick line or tubing string. In this case, when the sampling tool reaches the desired depth, one or more ports are actuated from the closed position to the opened position to allow collection of the formation fluids. The ports may be actuated in variety of ways such as by electrical, hydraulic or mechanical methods. Once the ports are opened, formation fluids travel through the ports and a sample of the formation fluids is collected within a chamber of the sampling tool. After the sample has been collected, the sampling tool may be withdrawn from the wellbore so that the formation fluid sample may be analyzed.

It has been found, however, that with the use of conventional formation sampling tools, the fluid sample is obtained relatively quickly which can cause phase change degradation of the formation fluid due to flashing as the fluid flows into the sampling chamber. This phase change degradation may result in irreversible chemical and physical changes in the formation fluid. For example, in a typical sampling procedure, the formation fluids flow through one or more valves or passageways to enter the sampling chamber. The inherent pressure drop across the valves or passageways creates the possibility that lighter fractions present in the sample will flash, or come out of solution, during collection. Once flashing has occurred, the resulting sample may no longer be representative of the fluids present in the formation.

It has also been found that as conventional formation sampling tools are retrieved from the wellbore, the reduction in hydrostatic pressure acting on the sampling tool may result in a reduction of the fluid pressure within the sampling chamber. This drop in pressure may similarly cause phase change degradation of the sample as the sampling tool is removed from the wellbore. In the past, it has been difficult to know whether the sample has undergone phase change degradation either during collection or retrieval from the wellbore. As such, it has been difficult to determine whether the sample is representative of the fluids present in the formation.

Therefore, a need has arisen for an apparatus and method for obtaining a fluid sample from a formation without phase change degradation of the sample during collection or retrieval of the sampling tool from the wellbore. A need has also arisen for such an apparatus and method that is capable of verifying whether the sample has undergone phase change degradation.

SUMMARY OF THE INVENTION

The present invention disclosed herein provides a downhole sampling apparatus and a method for obtaining a fluid sample from a formation without the occurrence of phase change degradation of the sample during collection or retrieval of the sampling tool from the wellbore. The downhole sampling apparatus and method of the present invention is capable of verifying whether the sample has undergone phase change degradation by monitoring the temperature of the sample during collection and retrieval of the downhole sampling apparatus from the wellbore.

In one embodiment, the downhole sampling apparatus of the present invention comprises a housing having a sampling chamber and a sampling port defined therein. The sampling port is in communication with the sampling chamber and the formation traversed by the wellbore. A temperature monitoring device is at least partially disposed within the sampling chamber. The temperature monitoring device monitors the temperature of formation fluid collected in the sampling chamber to determine whether the formation fluid undergoes phase change degradation. The temperature monitoring device is operatively connected to a temperature recorder so that temperature fluctuations in the formation fluid may be recorded.

In another embodiment, the downhole sampling apparatus of the present invention comprises a housing having a fluid passageway that is in communication with the formation. A sampling device is disposed within the housing. The sampling device has a sampling chamber and a sampling port defined therein. The sampling port is in communication with the sampling chamber and the fluid passageway. A temperature recorder is also disposed within the housing. The temperature recorder includes a temperature monitoring device that is in communication with the fluid passageway for monitoring the temperature of formation fluid entering the sampling port.

In either embodiment, a check valve is disposed within the sampling port for allowing formation fluid flow through the sampling port into the sampling chamber while preventing reverse flow from the sampling chamber out through the sampling port. The sampling device may also include first and second operating fluid chambers. A control valve is disposed between the first and second operating fluid chambers for initially isolating the first operating fluid chamber from the second operating fluid chamber. When the control valve is actuated, the first operating fluid chamber is in communication with the second operating fluid chamber such that operating fluid flows from the first operating fluid chamber to the second operating fluid chamber. Once this has occurred, formation fluid may flow through the sampling port into the sampling chamber. A flow restrictor may be use to impede the rate of fluid flow from the first operating fluid chamber to the second operating fluid chamber. A floating piston may be disposed between the sampling chamber and the first operating fluid chamber.

The sampling device may also have an isolation valve that allows outside hydrostatic pressure into the sampling device after a predetermined volume of operating fluid has flowed from the first operating fluid chamber to the second operating fluid chamber. A check valve may be used to trap the hydrostatic pressure within the sampling device.

In one the method of the present invention, the sampling device is run into the wellbore to a depth at which the formation fluids are to be sampled. The sampling tool then collects formation fluids from the formation in the sampling chamber through the sampling port. The temperature of formation fluids collected in the sampling chamber is monitored to determine whether the formation fluids undergo phase change degradation. The temperature of the formation fluids may be recorded with a temperature recorder.

In another method of the present invention, a housing having the sampling device and a temperature recorder disposed therein is run into the wellbore to a depth at which the formation fluids are to be sampled. The formation fluids are allowed to pass through a fluid passageway within the housing. Formation fluids are collected in a sampling chamber of the sampling device. The temperature of the formation fluids is measure by a temperature monitoring device as the fluids pass through the fluid passageway of the housing. The temperature recorder records the temperature measurement to determine of whether the formation fluids have undergone phase change degradation.

BRIEF DESCRIPTION OF THE DRAWINGS

For a more complete understanding of the present invention, including its features and advantages, reference is now made to the detailed description of the invention, taken in conjunction with the accompanying drawings in which like numerals identify like parts and in which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
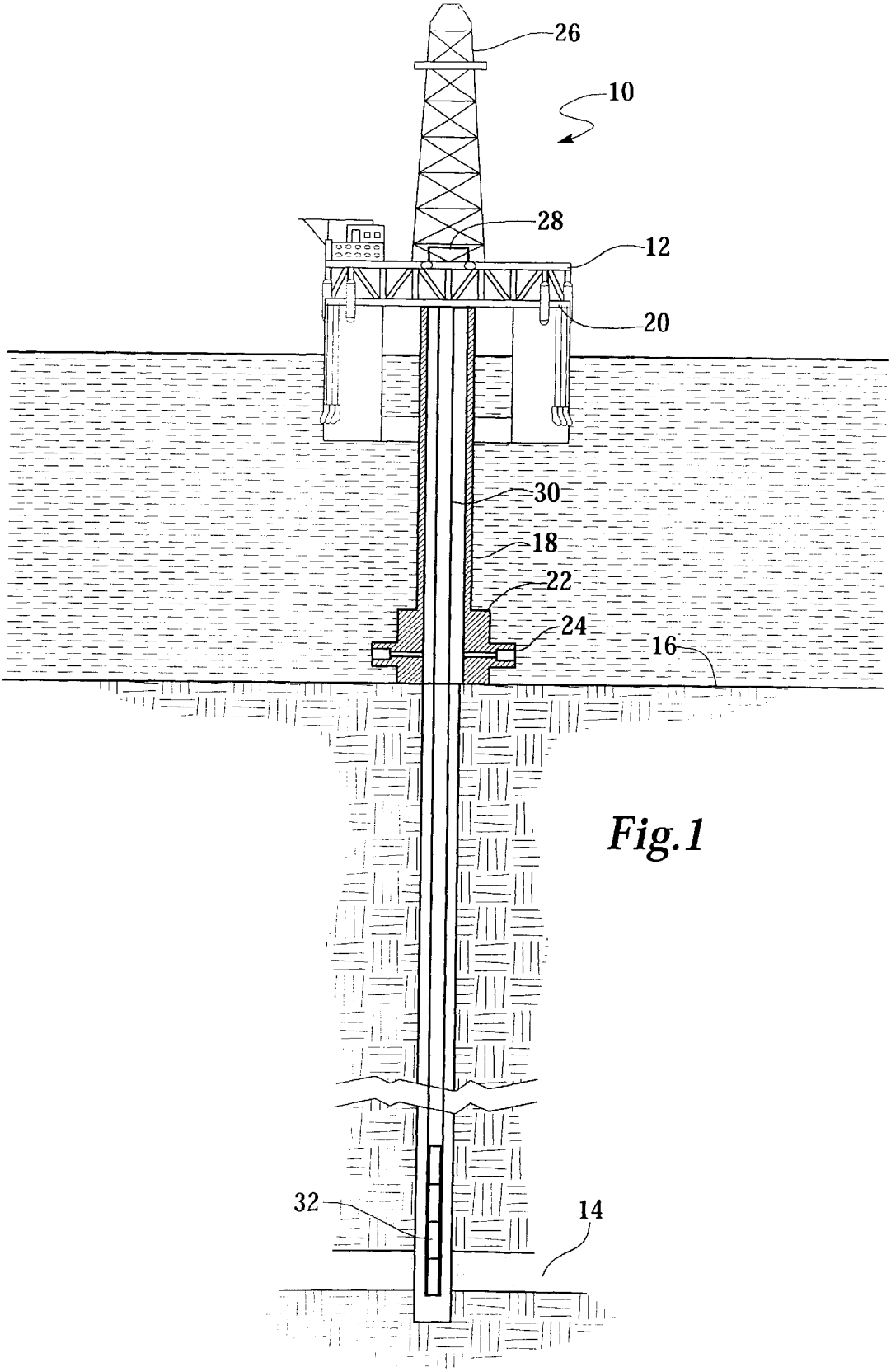
FIG. 1 is a schematic illustration of an offshore oil or gas drilling platform utilizing an apparatus for verification of monophasic samples of the of the present invention positioned adjacent to a formation to be tested.

Referring now to FIG. 1, an offshore oil and gas drilling platform operating an apparatus for verification of monophasic samples is schematically illustrated and generally designated 10. Semisubmersible platform 12 is positioned over a submerged oil or gas formation 14 located below sea floor 16. Conduit 18 extends from deck 20 of platform 12 to a well head installation apparatus 22 located adjacent to sea floor 16. The wellhead installation apparatus 22 typically includes blowout prevention devices 24. The platform 12 is equipped with derrick 26 and a hoisting apparatus 28 for raising and lowering tools drill string 30 and testing tools including an apparatus for verification of monophasic samples or sampling assembly 32.

Even though FIG. 1 depicts sampling assembly 32 of the present invention connected to drill string 30, it should be understood by those skilled in the art that sampling assembly 32 may alternatively be run downhole on a wireline, slick line or the like. It will also be apparent to one skilled in the art that sampling assembly 32 of the present invention is not limited to use with platform 12. Sampling assembly 32 is also well-suited for use with other offshore platforms or during onshore production operations.

Figure 2:
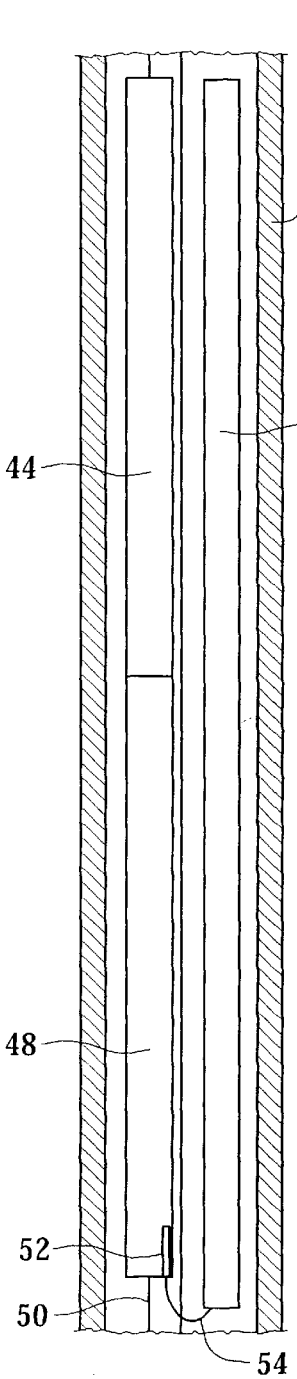
FIG. 2 is a schematic illustration of one embodiment of an apparatus for verification of monophasic samples of the present invention.

Referring now to FIG. 2, therein is depicted one embodiment of a sampling assembly of the present invention that is generally designated 40. Sampling assembly 40 may be lowered into place within the wellbore on a wireline (not pictured). Sampling assembly 40 has a housing 42 that surrounds sampling device 44 and temperature recorder 46. Sampling device 44 includes a sampling chamber 48. A sampling port 50 communicates sampling chamber 48 with the exterior of housing 42 such that fluids from formation 14 of FIG. 1 may be collected by sampling device 44, as will be more fully described below. A temperature sensor 52 is at least partially disposed within sampling chamber 48. Temperature sensor 52 is operably connected to temperature recorder 46 via coupling 54.

The temperature sensor 52 may be a thermocouple, an RTD or other temperature measuring device. Temperature sensor 52 monitors temperature changes occurring during collection and retrieval of fluid samples from formation 14. Temperature recorder 46 is used for recording variations in the temperature of the sample as a function of time. Temperature variations during the collection and retrieval operation can provide the operator with information regarding the sampling process including information indicating whether the fluid has undergone phase change degradation resulting in chemical and/or physical changes in the formation fluid making the sample less representative of the formation fluids as they exist in formation 14.

For example, if the temperature profile measured during the collection and retrieval process remains relatively constant, this tends to indicate that no significant portion of the sample has flashed. This type of constant temperature profile, therefore, indicates that no significant phase changes have occurred, thereby indicating that a representative sample of the formation fluids as they exist in the formation has been obtained.

Alternatively, if a significant temperature fluctuation is recorded by temperature recorder 46, this tends to indicate that flashing has occurred and that the fluid has undergone phase change degradation. Since flashing is an endothermic process, the flashing of a low molecular fraction of the sample will cause a decrease in the temperature of the sample. Such a decrease in temperature may indicate that the sample is not monophasic and is now less representative of the formation fluids as they existed in the formation.

In operation, either the magnitude of the observed temperature change or the rate of temperature change, may be indicative of phase change degradation of the sample. Thus, when the sample is retrieved, the operator may review the temperature history of the sample recorded by recorder 46 to determine whether resampling of the formation fluids is necessary to obtain a more representative sample of formation fluid. The decision whether or not to resample may be based either upon the magnitude of the observed temperature change, ($\Delta$temp), the rate of temperature change, ($\Delta$temp/$\Delta$t), or a combination of both.

Figure 3:
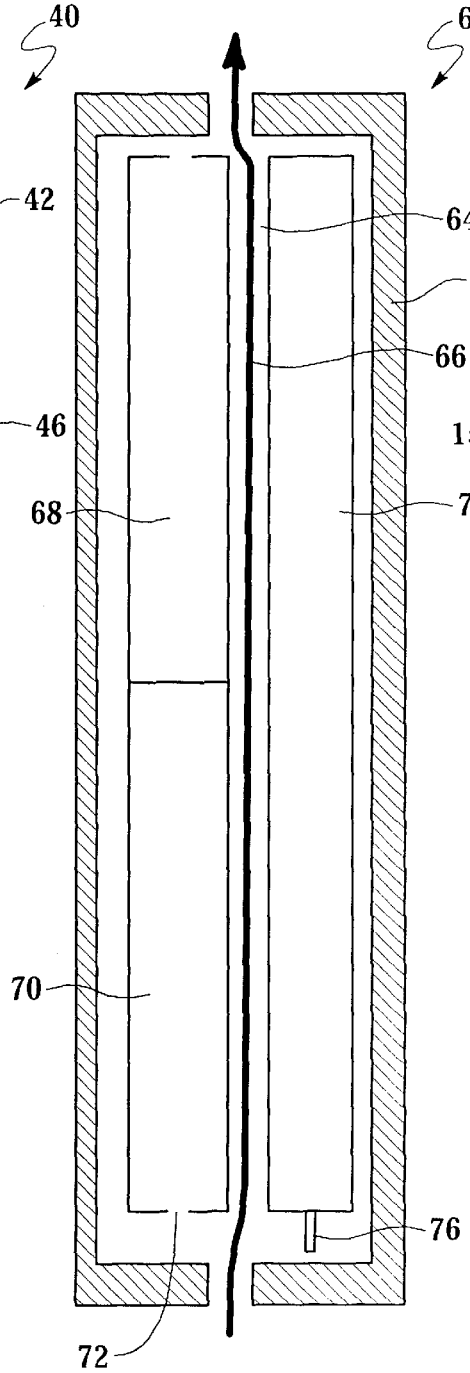
FIG. 3 is a schematic illustration of another embodiment of an apparatus for verification of monophasic samples of the present invention.

Referring now to FIG. 3, therein is depicted another embodiment of a sampling assembly that is generally designated 60. Sampling assembly 60 may typically be lowered into the wellbore as part of a pipe string such as drill string 30. Sampling assembly 60 has a housing 62 and defines a fluid passageway 64 that allows formation fluids to travel therethrough as indicated by arrow 66. Disposed within housing 62 is a sampling device 68 that includes a sampling chamber 70. A sampling port 72 is in communication with sampling chamber 70 and fluid passageway 64. Also disposed within housing 62 is temperature recorder 74. Temperature recorder 74 includes a temperature sensor 76 that is in fluid communication with fluid passageway 64. In this embodiment, temperature recorder 74 records fluctuations in the temperature of the formation fluids flowing through fluid passageway 64. As explained above, when a sample is collected in sampling chamber 70, if the temperature profile remains relatively constant, this indicates that no significant phase change has occurred. If, on the other hand, a significant temperature fluctuation is recorded by temperature recorder 46, this indicates that flashing has occurred and that the fluid in the sample may have undergone phase change degradation.

Figure 4A:
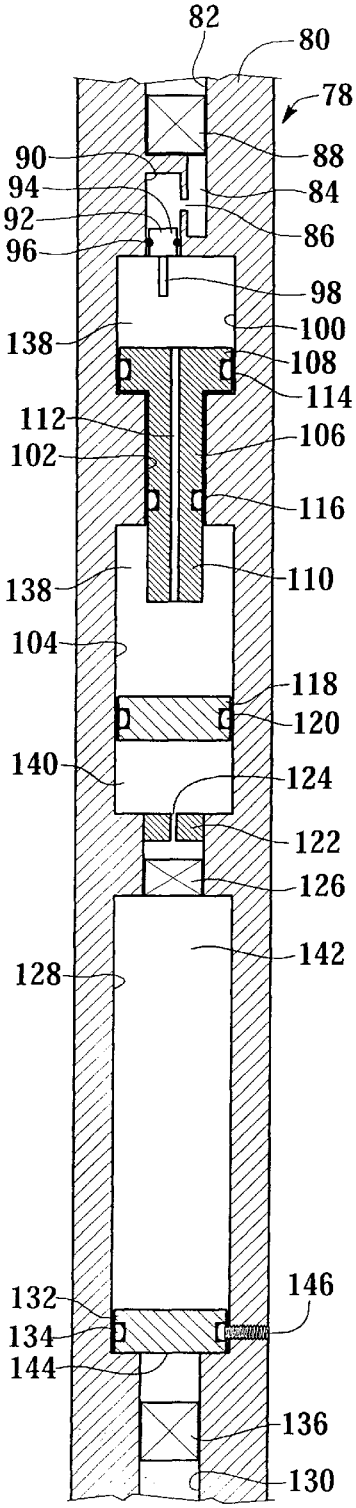
FIGS. 4A–4C are schematic illustrations of a sampling device in its various positions for use with an apparatus for verification of monophasic samples of the present invention.
Figure 4B:
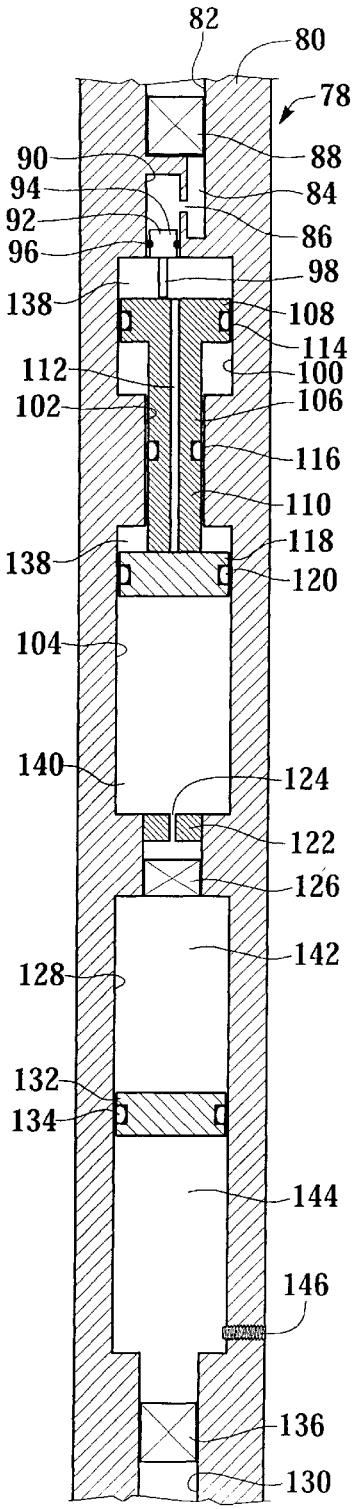
Figure 4C:
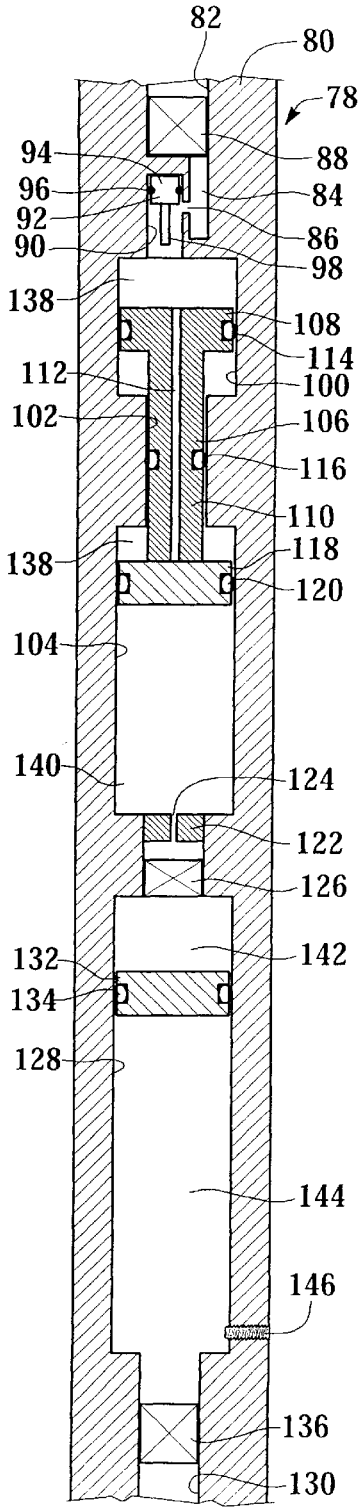

Referring next to FIGS. 4A–4C, therein is depicted a sampling device 78 suitable for use with sampling assembly 40 of FIG. 2 or sampling assembly 60 of FIG. 3. Sampling device 78 has a housing 80 that defines a flow passageway 82 and a passage 84. Passage 84 includes a transverse portion 86. A check valve 88 such as a ball check valve, is disposed in fluid passageway 82. Housing 80 defines an off-center longitudinal bore 90 therein which intersects transverse passage portion 86 and thus is in communication with passageway 82. An isolation valve 92, such as a sliding isolation valve, is disposed in bore 90. An enlarged upper portion 94 of isolation valve 92 carries a seal 96 thereon. Seal 96 seals on opposite sides of horizontal portion 86 of passage 84 when isolation valve 92 is in the initial position shown in FIG. 4A. A smaller diameter lower portion 98 of isolation valve 92 extends downwardly from upper portion 94.

Housing 80 defines a first bore 100, a smaller second bore 102 and a third bore 104 therein which is larger than second bore 102. A plunger 106 is disposed in housing 80 and has an enlarged upper end 108 slidably disposed within first bore 100 of housing 80 and a smaller lower end 110 slidably disposed in second bore 102. It will be seen that an annular area differential is defined between enlarged upper end 108 and smaller lower end 110 of plunger 106. Plunger 106 defines a longitudinally extending opening 112 therethrough. A seal 114 provides sealing engagement between upper end 108 of plunger 106 and first bore 100, and similarly, another seal 116 provides sealing engagement between lower end 110 and second bore 102. A floating piston 118 is disposed in third bore 104 of housing 80 and is initially spaced below plunger 106. Sealing is provided between floating piston 118 and third bore 104 by seal 120.

Disposed below third bore 104 is a flow restrictor 122 having a flow restriction port 124 that is sized sufficiently small to restrict fluid flow therethrough. Flow restriction port 124 may also be referred to as orifice 124. Other flow restriction devices, such as removable orifices may also be used. Flow restrictor 122 is used for impeding fluid flow therethrough, as will be further described herein.

A control valve 126 is disposed in housing 80 for initially isolating the lower portion of housing 80 from the upper portion of housing 80 and for placing the lower portion of housing 80 in communication with the upper portion of housing 80 when activated. Control valve 126 may be actuated with an annulus pressure responsive activator. Other types of activators, however, such as an electronically controlled solenoid valve, or other means for opening a port known in the art may be used.

Below control valve 126, housing 80 defines fourth bore 128 and fifth bore 130. Fifth bore 130 may also be referred to as a sampling port 130. A floating piston 132 is disposed within fourth bore 128. A seal is provided therebetween by seal 134. A check valve 136 is disposed in sampling port 130 for allowing fluid flow therethrough into housing 80 while preventing fluid flow from housing 80 outwardly through sampling port 130.

An air cavity 138 is defined within first bore 100, second bore 102 and third bore 104 above floating piston 118. Air cavity 138 is initially filled with atmospheric air. Opening 112 through plunger 106 insures that pressure is equalized within air cavity 138.

An upper hydraulic fluid chamber 140 is defined in housing 80 between floating piston 118 and control valve 126. Thus, floating piston 118 is in communication with upper hydraulic fluid chamber 140 and air chamber 138, and floating piston 118 separates upper hydraulic fluid chamber 140 from air chamber 138.

A lower hydraulic fluid chamber 142 is defined in housing 80 below control valve 126 and above floating piston 132. Upper and lower hydraulic fluid chambers 140 and 142 are filled with low pressure hydraulic fluid when sample device 78 is assembled. A sampling chamber 144 is defined between floating piston 132 and check valve 136. Sampling chamber 144 enlarges to receive a fluid sample by movement of floating piston 132. Extending partially into sampling chamber 144 is temperature sensor 146 that is used to monitor the temperature of the fluid sample within sampling chamber 144 during collection of formation fluids and the retrieval of sampling device 78 from the wellbore as explained above.

In operation, once sampling device 78 is positioned within the wellbore proximate formation 14 of FIG. 1, control valve 126 may be activated. Tubing pressure may be communicated through open check valve 136 and sampling port 130 to sampling chamber 144. This pressure is communicated through floating piston 132 and thereby communicated to the hydraulic fluid in lower hydraulic fluid chamber 142.

As previously stated, orifice 124 acts as a flow restrictor for impeding fluid flow from lower hydraulic fluid chamber 142 into upper hydraulic fluid chamber 140. That is, this flow restrictor allows higher pressure hydraulic fluid in lower hydraulic fluid chamber 142 to bleed slowly across the fluid restriction into upper hydraulic fluid chamber 140.

As floating piston 132 moves inside fourth bore 128, sampling chamber 144 is enlarged. As floating piston 132 moves upwardly, the hydraulic fluid in lower hydraulic fluid chamber 142 above floating piston 132 will continue to flow into upper hydraulic fluid chamber 140. This causes floating piston 118 in third bore 104 to be moved upwardly until it engages lower end 110 of plunger 106, as seen in FIG. 4B. As plunger 106 moves upwardly, plunger 106 engages isolation valve 92 placing isolation valve 92 in the open position shown in FIG. 4C.

When isolation valve 92 is in this open position, outside hydrostatic pressure is allowed to flow into air chamber 138 through passageway 82. This hydrostatic fluid pressure acts against the area differential defined between enlarged upper end 108 and lower end 110 of plunger 106 and forces plunger 106, and thus floating piston 118, downwardly. The downward movement causes some reverse fluid flow and increased pressure in upper and lower hydraulic fluid chambers 142 and 144 and therefore in sampling chamber 144. This causes check valve 136 to be moved to the closed position.

It will be seen by those skilled in the art that the hydraulic fluid and the fluid sample are thus pressurized to a pressure above the well hydrostatic pressure. Check valve 88 in passageway 82 will close and trap the hydrostatic pressure inside housing 80 which continues to act downwardly on plunger 106. Sampling device 78 may then be retrieved with the fluid sample contained in sampling chamber 144 at a pressure above the well hydrostatic pressure.

The slow movement of fluid from lower hydraulic fluid chamber 142 to upper hydraulic fluid chamber 140 through orifice 124 allows the fluid sample to flow slowly into sampling chamber 144, thereby preventing fluid flashing. Keeping the fluid sample at a pressure above hydrostatic pressure greatly reduces or eliminates phase change degradation of the sample as sampling device 78 is removed from the wellbore.

During the entire collection and retrieval process, temperature sensor 146 monitors the temperature of the sample in sampling chamber 144. As explained above, these temperature measurements may be recorded with a temperature recorded such as temperature recorder 46 of FIG. 2. After sampling device 78 is removed from the wellbore, the temperature profile from the temperature recorder may be analyzed to verify that the sample is monophasic. If significant temperature variations have occurred in the sample, resampling may be required to obtain a sample that is more representative of the fluids as they exist in formation 14.

Figure 5:
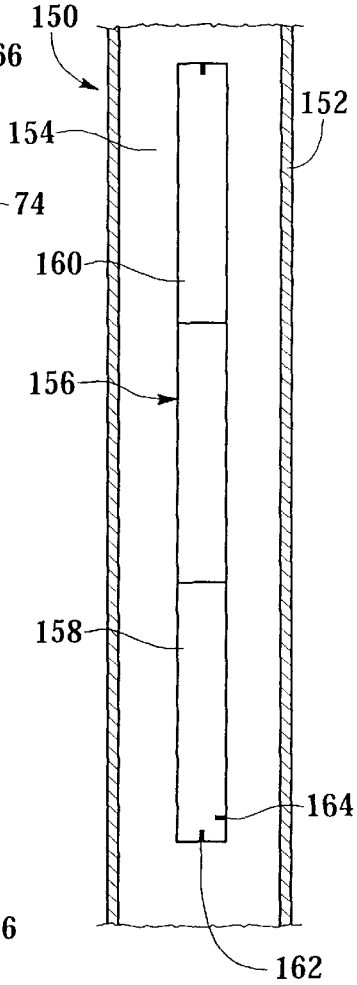
FIG. 5 is a schematic illustration of another embodiment of an apparatus for verification of monophasic samples of the present invention.

Referring now to FIG. 5, therein is depicted another embodiment of a sampling assembly that is generally designated 150. Sampling assembly 150 may typically be lowered into the wellbore as part of a pipe string such as drill string 30. Sampling assembly 150 has a housing 152 and defines a fluid passageway 154 that allows formation fluids to travel therethrough. Disposed within housing 152 is a sampling device 156. Sampling device 156 includes a sampling chamber 158 and a temperature recorder 160. A sampling port 162 is in communication with sampling chamber 158 and fluid passageway 154. Temperature recorder 160 is operably coupled to a temperature sensor 164 that monitors the temperature of fluids within sampling chamber 158. As explained above, when a sample is collected in sampling chamber 158, if the temperature profile remains relatively constant, this indicates that no significant phase change has occurred. If, on the other hand, a significant temperature fluctuation is recorded by temperature recorder 160, this indicates that flashing has occurred and that the fluid in the sample may have undergone phase change degradation.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. A method for sampling formation fluids comprising the steps of:

running a fluid sampling device into a wellbore to a depth at which the formation fluids are to be sampled, the fluid sampling device having a sampling chamber, first and second operating fluid chambers and a sampling port defined therein, the sampling port being in communication with the sampling chamber and a formation outside of the sampling tool;

collecting formation fluids from the formation in the sampling chamber through the sampling port;

opening a control valve to allow operating fluid to flow from the first operating fluid chamber into the second operating fluid chamber; and monitoring the temperature of the formation fluids collected in the sampling chamber to determine whether the formation fluids undergo phase change degradation.

2. The method as recited in claim 1 further comprising the step of recording the temperature of the formation fluids with a temperature recorder.

3. The method as recited in claim 1 wherein the step of collecting formation fluids further comprises allowing the formation fluids to flow through a check valve in the sampling port and preventing reverse flow from the sampling chamber out through the check valve in the sampling port.

4. The method as recited in claim 1 wherein the step of collecting formation fluids further comprises operating a floating piston between the sampling chamber and the first operating fluid chamber.

5. The method as recited in claim 1 wherein the step of collecting formation fluids further comprises allowing outside hydrostatic pressure into the fluid sampling device after a predetermined volume of operating fluid has flowed from the first operating fluid chamber to the second operating fluid chamber.

6. The method as recited in claim 5 wherein the step of collecting formation fluids further comprises trapping the hydrostatic pressure in the fluid sampling device.

7. The method as recited in claim 1 wherein the step of collecting formation fluids further comprises impeding the flow between the first operating fluid chamber and the second operating fluid chamber with a flow restrictor.

8. A method for verification of a monophasic formation fluid sample comprising:

running a fluid sampling apparatus into a wellbore to a depth at which the formation fluids are to be sampled, the fluid sampling apparatus having a fluid passageway therethrough in communication with a formation outside of the fluid sampling apparatus, the fluid sampling apparatus comprising a sampling device disposed within the fluid sampling apparatus, the sampling device having a sampling chamber and a sampling port defined therein, the sampling port being in communication with the sampling chamber and the fluid passageway; and a temperature recorder disposed within the fluid sampling apparatus, the temperature recorder including a temperature monitoring device in communication with the fluid passageway; collecting formation fluids from the formation in the sampling chamber through the sampling port; and monitoring the temperature of formation fluids flowing through the fluid passageway with the temperature monitoring device to determine whether the formation fluids undergo phase change degradation.

9. The method as recited in claim 8 wherein the step of collecting formation fluids further comprises allowing the formation fluids to flow through a check valve in the sampling port and preventing reverse flow from the sampling chamber out through the check valve in the sampling port.

10. The method as recited in claim 8 wherein the step of collecting formation fluids further comprises operating a control valve disposed between first and second operating fluid chambers in the sampling device and flowing operating fluid from the first operating fluid chamber to the second operating fluid chamber.

11. The method as recited in claim 10 wherein the step of collecting formation fluids further comprises operating a floating piston between the sampling chamber and the first operating fluid chamber.

12. The method as recited in claim 10 wherein the step of collecting formation fluids further comprises allowing outside hydrostatic pressure into the sampling device after a predetermined volume of operating fluid has flowed from the first operating fluid chamber to the second operating fluid chamber.

13. The method as recited in claim 12 wherein the step of collecting formation fluids further comprises trapping the hydrostatic pressure in the sampling device.

14. The method as recited in claim 10 wherein the step of collecting formation fluids further comprises impeding the flow between the first operating fluid chamber and the second operating fluid chamber with a flow restrictor.

* * * * *